United States Patent [19]

Watt et al.

[11] 4,307,912

[45] Dec. 29, 1981

[54] MULTIPLE POSITION RECLINING CHAIR ASSEMBLY

[75] Inventors: Richard L. Watt; Warren A. Waxham, both of Jamestown, N.Y.

[73] Assignee: Weber-Knapp Company, Jamestown, N.Y.

[21] Appl. No.: 148,741

[22] Filed: May 12, 1980

[51] Int. Cl.[3] ..... A47C 1/02; A61G 15/00

[52] U.S. Cl. ..... 297/85; 297/90; 297/321

[58] Field of Search ..... 297/83, 88, 90, 321, 297/85

[56] References Cited

U.S. PATENT DOCUMENTS

| | | | |
|---|---|---|---|
| 2,750,988 | 6/1956 | Luckhardt | 155/106 |
| 2,788,058 | 4/1957 | Luckhart | 155/106 |
| 3,062,581 | 11/1962 | Fletcher | 297/89 |
| 3,139,305 | 6/1964 | Mizelle | 297/317 |
| 3,243,225 | 3/1966 | Katz | 297/75 |
| 3,383,135 | 5/1968 | Posh | 297/355 |
| 3,714,680 | 2/1973 | Little | 16/90 |
| 3,743,349 | 7/1973 | Crum et al. | 297/85 |
| 3,756,651 | 9/1973 | Sloan | 297/85 |
| 4,071,275 | 1/1978 | Rogers | 297/85 |
| 4,195,878 | 4/1980 | Cycowicz | 297/83 |

OTHER PUBLICATIONS

Greenwood, D. C., "Engineering Data for Product Design", McGraw-Hill Co., N.Y., N.Y., 1961, pp. 322–323.

*Primary Examiner*—Ronald Feldbaum

*Attorney, Agent, or Firm*—Bean, Kauffman & Bean

[57] ABSTRACT

A multi-position, wall avoiding reclining chair assembly having a unitized metal frame construction and featuring an improved linkage for supporting a chair seat for forwardly directed movement relative to a chair supporting base, as the chair assumes an intermediate reclined or TV position. The chair assembly also features an improved mechanism permitting the application of pressure to a back rest to initiate movement of the chair seat and a foot rest relative to the chair supporting base between their upright and reclined positions without producing substantial coincident rearwardly directed reclining movements of the back rest relative to the chair seat. After the chair seat and foot rest are disposed in their reclined positions to define the intermediate reclined or TV position of the chair, the application of pressure to the back rest will effect movement thereof into its reclined position to thereby define the fully reclined position of the chair.

9 Claims, 8 Drawing Figures

MULTIPLE POSITION RECLINING CHAIR ASSEMBLY

BACKGROUND OF THE INVENTION

The present invention relates to a multiple position reclining chair assembly, and more particularly to improvements in wall avoiding chair assemblies of the type generally described in U.S. Pat. No. 3,743,349, wherein a chair seat is supported for forwardly directed movement relative to a support or base as the chair assumes a reclined position.

In this prior patent a linkage means is disclosed as being provided to operably interconnect a seat portion, a mounting linkage for a foot rest and a base portion or support, such that the seat portion may be moved from an upright position forwardly relative to the base portion into a reclined position, while at the same time the mounting linkage is actuated to move the foot rest between a collapsed storage position and an extended leg supporting position.

A drawback of this prior construction is that the pivotal connection between the front of the seat portion and its supporting strut is required to move along an arcuate path of travel as the seat portion moves between upright and reclined positions. Practical limitations imposed on the radius of curvature of this path of travel and the desire to maximize the extent of forwardly directed movement of the seat portion relative to the base portion in order to minimize required spacing between the back of the chair and an adjacent wall result in the pivotal connection being forced to undergo noticeable vertical displacements incident to its movement between positions corresponding to the upright and reclined positions of the seat portion. Such vertical displacements in any substantial degree are undesirable in that they increase the degree of effort which an occupant must exert to operate the chair and tend to subject the occupant to a high speed falling sensation, as the chair approaches one or the other of its upright and reclined positions.

SUMMARY OF THE INVENTION

The present invention provides an improved linkage means for supporting a seat portion of a multi-position reclining chair for forwardly directed reclining movements relative to a base portion or support.

In accordance with a preferred form of the present invention, the linkage means includes an improved front linkage for mounting the front of the seat portion for movement relative to the base portion. Specifically, this linkage includes a front strut, an upper front pivot for connecting an upper portion of the front strut to the seat portion and a compound linkage for connecting a lower portion of the strut to the base portion in a manner permitting movement of the upper front pivot along a generally horizontally disposed path of travel incident to movement of the seat portion between its upright and reclined positions. Preferably, however, the compound linkage is designed to provide for stable upright and reclined positions of the seat portion by arranging the upper front pivot, when in its upright and reclined positions, slightly below intermediate positions it assumes during a substantial portion of its travel between such upright and reclined positions. While force is required to vertically displace the upper front pivot in order to initiate movement of the seat portion from both its upright and reclined positions, the overall effort required by an occupant to operate the chair may be reduced.

The present linkage also includes a control link, which is employed to operably couple the front strut with a mounting linkage for a foot rest to provide for movement of the foot rest between collapsed storage and extended leg supporting positions incident to movement of the seat portion between its upright and reclined positions. The control link is also operably associated with chair operating means and movable thereby to initiate reclining movements of the seat portion and extension of the foot rest mounting linkage. The operating means need only move or drive the control link through a given distance, which is sufficient to move the upper front pivot to one of its intermediate positions at which the weight of a chair occupant becomes effective for purposes of completing reclining movements of the seat portion and extension of the foot rest mounting linkage.

The present invention additionally provides an improved operating means controlled by the application of pressure to the back rest of the chair for initiating reclining movements of the seat portion and extension of a foot rest mounting linkage. Specifically, the operating means includes a friction device formed with a friction surface and mounted on the seat portion for movement between operative and inoperative positions; a control rod having a rear end pivotally mounted on the back rest and a front end slideably supported by the friction device and arranged to drivingly engage with the control link; a spring tending to oppose rearwardly directed pivotal movement of the back rest relative to the seat portion towards its reclined position and to bias the friction device from its inoperative position into its operative position; and a control pin carried by the front strut and arranged to engage with the friction device for maintaining same in its inoperative position until the control link has been driven through a distance sufficient to place the upper front pivot in its intermediate position at which the weight of the chair occupant becomes effective to propel the seat portion towards its reclined position. When the friction device is in its operative position, it serves to snub or provide a frictional braking force, which varies with the amount of bias developed by the spring and opposes movement of the control rod resulting from pivotal movements of the back rest between its upright and reclined positions. This frictional braking force acts in conjunction with the bias of spring to oppose movement of the back rest towards its reclined position and in opposition to such bias during movement of the back rest towards its upright position.

The present operating means and mode of operably coupling same with the control link, permits a chair occupant to initiate movement of the chair into an intermediate reclined or TV position by applying pressure to the back rest in order to pivot same from its upright position by an amount sufficient to effect desired driven displacement of the control link. During this initial phase of pivotal movement of the back rest, which in the present construction need only be relatively slight as for instance on the order of about five degrees, the friction device is rendered inoperative and thus the only restraining force the occupant need overcome is that established by the bias of the spring. However, after this initial phase of pivotal movement, the friction device becomes effective and cooperates with the spring to effectively constrain continued pivotal movement of the back rest until after the chair has been placed in its intermediate reclined position and pressure is purposely applied to the back rest by the occupant in an amount exceeding that required to initiate reclining movements of the seat portion. Depending on the stature and weight of the occupant, the amount of pressure exerted by simply leaning or resting the back of the occupant on the back rest, while the chair is in its intermediate reclined position, will normally be such as will permit the spring to maintain the back rest in its upright position.

The chair may be returned to its upright position from its intermediate reclined position by the application of pressure to the foot rest in an amount exceeding that normally exerted on the foot rest by the weight of the feet and legs of the occupant.

DRAWINGS

FIG. 1. is a perspective view of a reclining chair formed in accordance with the present invention and shown in its upright position;

DETAILED DESCRIPTION

Figure 1:
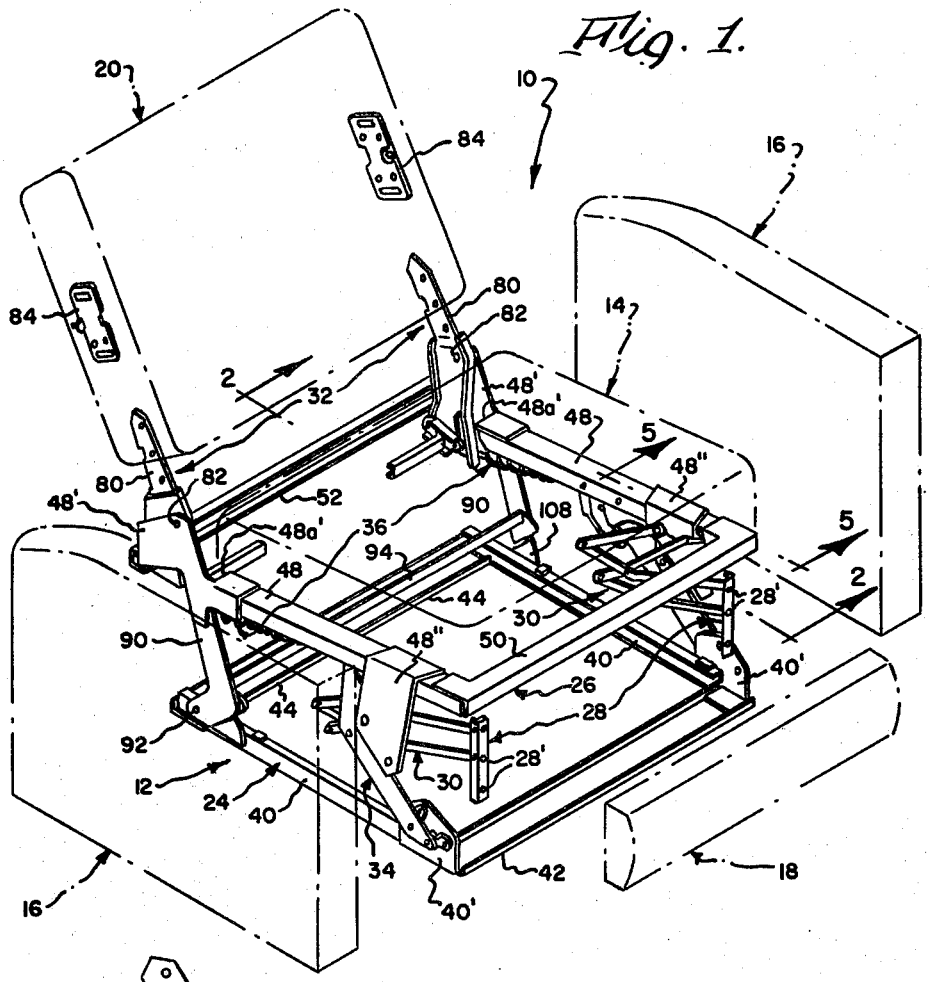

Reference is first made to FIG. 1, wherein a chair formed in accordance with a preferred form of the present invention is designated as 10 and shown as generally including a unitized, metal chair supporting frame 12; a seat unit 14; a pair of arm rest units 16 and 16; a foot rest unit 18; and a back rest unit 20. The seat, arm rest, foot rest and back rest units may be suitably fabricated prior to mounting thereof on frame 12.

Chair frame 12 is also best shown in FIG. 1, as generally comprising a base portion 24, which is intended to support the chair frame on a floor or other supporting surface; a seat portion 26; a foot rest portion 28; a mounting linkage 30 for mounting foot rest portion 28 on seat portion 26; a back rest portion 32 mounted on seat portion 26; linkage means 34 operably interconnecting base portion 24, seat portion 26 and mounting linkage 30 and operating means 36 for actuating linkage means 34.

Base portion 24 is shown in FIGS. 1-4 as including base side channels 40 and 40, which have their front ends fixed to upstanding mounting flanges 40′ and 40′; and base front and rear channels 42 and 44, which have their ends suitably fixed to the mounting flanges and the rear ends of the side channels, respectively, so as to define a rigid, rectangular base construction. If desired, based portion 24 may be spaced from the floor or other suitable support by corner mounted feet or glides 46.

Seat portion 26 is also best shown in FIGS. 1-4 as generally including seat side angle members 48 and 48, which have their rear ends fixed to upstanding rear mounting flanges 48′ and 48′; and seat front and rear channels 50 and 52, which are suitably secured to the front ends of the side angle members and to the rear mounting flanges, respectively, so as to define a rigid, rectangular seat construction. Further, seat portion 26 is shown as being fitted with a pair of inverted, generally U-shaped front mounting brackets or flanges 48″ and 48″, which depend from adjacent front ends of side angle members 48 and 48. It will be understood that seat unit 14 may be supported on seat portion 26 in any desired manner, such as by providing the seat portion with conventional spring elements, not shown, having their opposite ends fixed to side angle members 48 and 48 or front and rear channels 50 and 52, as desired. Further, it will be understood that arm rest units 16 and 16 may be supported on seat portion 26 in any desired manner, such as by fastener devices, not shown, received within mounting openings 54 provided for example in mounting flanges 48′, 48′,48″ and 48″.

Figure 2:
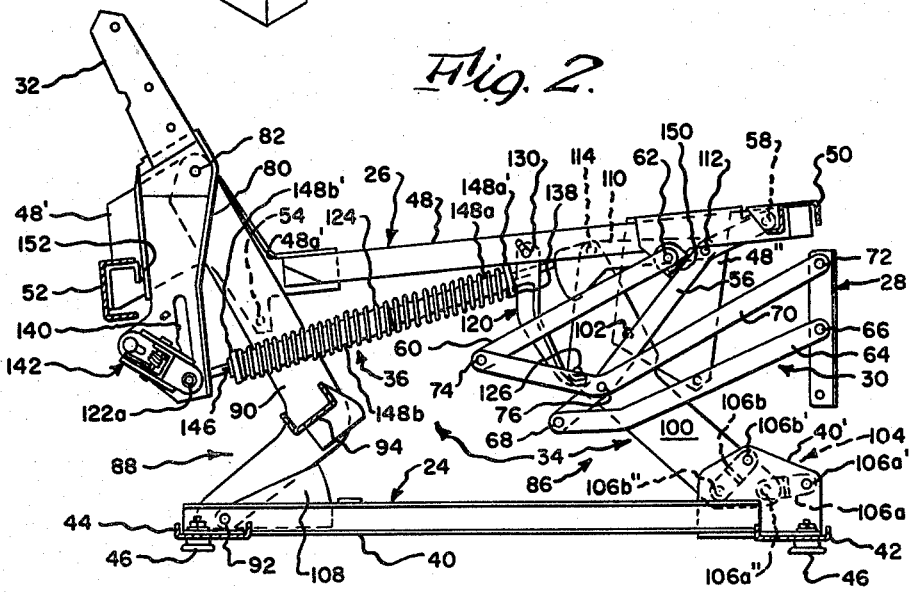
FIG. 2 is a sectional view taken generally along line 2—2 in FIG. 1 and showing the chair in its upright position.
Figures 3, 4:
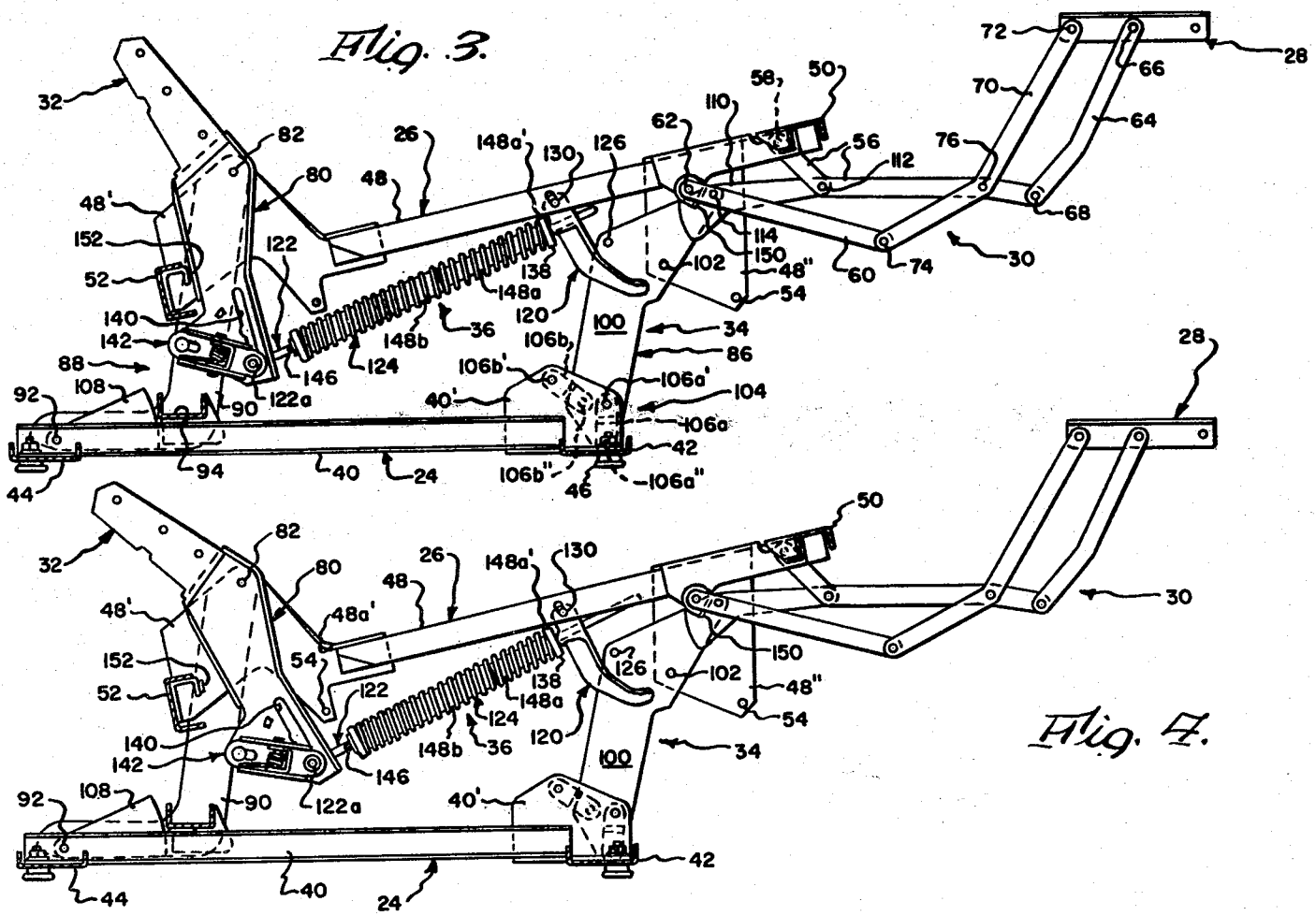
FIG. 3 is a sectional view similar to FIG. 2, but showing the chair in its intermediate reclined or TV position.
FIG. 4 is a sectional view similar to FIG. 2, but showing the chair disposed in a partial back rest reclined position intermediate its TV and fully reclined positions.

Foot rest portion 28 and its mounting linkage 30 are best shown in FIG. 1 as comprising separate right and left hand units of mirror image construction. Accordingly, only the right hand unit viewed in FIGS. 2-4 need be specifically described. Preferably, each unit comprising foot rest portion 28 is formed from a single angle member having openings 28′ for receiving threaded fasteners or other devices, not shown, suitable to permit mounting of foot rest unit 18 thereon. With the right and left hand units of foot rest portion 28 fixed to opposite ends of foot rest unit 18, there would normally be no need to provide additional bracing extending between the right and left hand units in order to insure conjunctive movement thereof. Referring specifically to FIGS. 2 and 3, it will be understood that each unit of mounting linkage 30 includes a first link 56 having its first or upper end pivotally secured to an associated side angle member 48 by a pivot pin 58; a second link 60 having its first or upper end pivotally mounted on an associated seat front bracket 48″ by pivot pin 62; a third link 64, which has its front and rear ends pivotally connected to an associated unit of foot rest portion 28 and a second or lower end of first link 56 by pivot pins 66 and 68, respectively; and a fourth link 70, which has its front and rear ends connected to the associated unit of foot rest portion 28 and the second or lower end of second link 60 by pivot pins 72 and 74, respectively, and its intermediate portion connected to an intermediate portion of first link 56 by a pivot pin 76. As will be apparent from viewing FIGS. 2-3, linkage 30 is of conventional construction and adapted to support foot rest portion 28 on seat portion 26 for movement from a collapsed storage position shown in FIG. 2 to an extended supporting position shown in FIG. 3 incident to movement of seat portion 26 between its upright and reclined positions in the manner to be hereinafter described.

Again referring to FIG. 1, it will be seen that back rest portion 32 is defined by right and left hand back rest units of mirror image construction, wherein each unit comprises a mounting bracket 80, which is preferably fixed to seat portion 26 by an upper rear pivot pin 82, and a separate bracket 84, which is suitably fixed to back rest unit 20 and adapted to be slidably, removably mounted on mounting bracket 80. Suitable fastener means, not shown, may be provided to releasably lock bracket 84 to bracket 80. In that the right and left hand units of back rest portion 32 are adapted to be fixed to opposite side edges of back rest unit 20, there would normally be no need to provide additional bracing between mounting brackets 80 and 80 in order to insure conjunctive movement thereof relative to seat portion 26. The utilization of separate brackets 84 to permit a separately fabricated back rest to be removably attached to mounting brackets comprising part of a chair frame is conventional and thus forms no part of the present invention.

Again referring to FIG. 1, it will be understood that linkage means 34 is also formed by right and left hand units of mirror image construction, and accordingly, only the right hand unit shown in FIGS. 2–4 need be described. Specifically, the right hand unit of linkage means 34 includes front and rear linkage means, which are generally designated as 86 and 88, respectively, and shown as serving to mount front and rear portions of seat portion 26 for movement relative to base portion 24 between its upright and reclined positions shown in FIGS. 2 and 3, respectively. In the presently preferred construction, rear linkage means 88 includes a rear strut 90 whose upper end is pivotally connected to rear mounting bracket 48' by above described upper rear pivot means 82 and whose lower end is pivotally connected to the rear end of base side channel 40 by lower rear pivot means in the form of a pivot pin 92. If desired, rear linkage means 88 may be braced by means of a channel member 94 having its opposite ends fixed to the rear struts 90 and 90. Front linkage means 86 includes a front strut 100; an upper front pivot means in the form of a pivot pin 102, for pivotally connecting an upper portion of the front strut to front seat mounting flange 48''; and a compound linkage means generally designated as 104 for coupling a lower portion of front strut 100 to front base mounting flange 40'. Compound linkage means 104 comprises a pair of front and rear hanger links **106*a* and 106*b* having first ends pivotally mounted on front base mounting flange 40' by a pair of pivot pins 106*a'* and 106*b'* and second ends pivotally connected to the lower end portion of strut 100 by pivot pins 106*a''* and 106*b''***.

If desired, safety shield plates 108 suitably retained in position, as by pivot pins 92, may be employed to prevent accidental insertion of objects between rear struts 90 and base side channels 40 during reclining movements of seat portion 26.

Linkage means 34 additionally includes a control link 110, which is pivotally connected adjacent its front and rear ends to first link 56 and front strut 100 by pivot pins 112 and 114, respectively. Further, control link 110 is formed with a convex bearing surface 116, which cooperates with operating means 36 in a manner to be subsequently described with particular reference to FIGS. 5 and 6 for the purpose of initiating reclining movements of seat portion 26 and extension of foot rest portion 28.

By again making reference to FIG. 1, it will be understood that operating means 36 is also formed from right and left hand units of mirror image construction. The right hand unit is shown in FIGS. 2–8 as generally including a friction or motion snubbing device 120, which is mounted on seat portion 26; a control rod 122, which has its front and rear ends supported by friction device 120 and back rest mounting bracket 80, respectively; a spring device such as a coil type compression spring 124 carried by control rod 122; and a control pin 126 carried by front strut 100.

Figure 5:
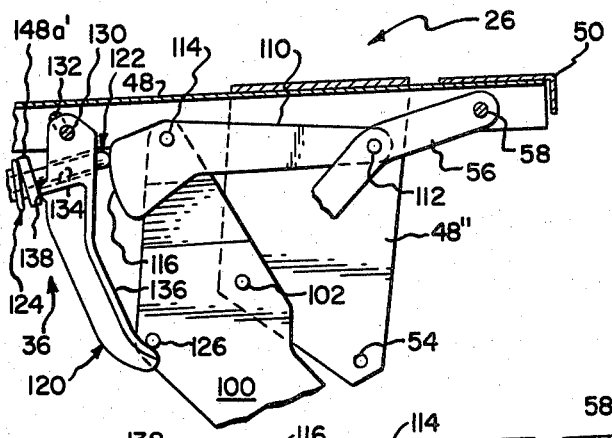
FIG. 5 is a sectional view taken generally along line 5—5 in FIG. 1 and showing chair components in chair upright position.
Figure 6:
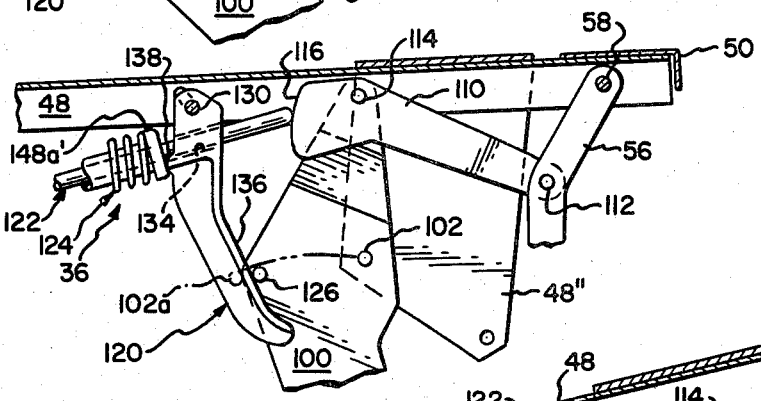
FIG. 6 is a sectional view similar to FIG. 5, but showing chair components intermediate chair upright and intermediate reclined positions.
Figure 7:
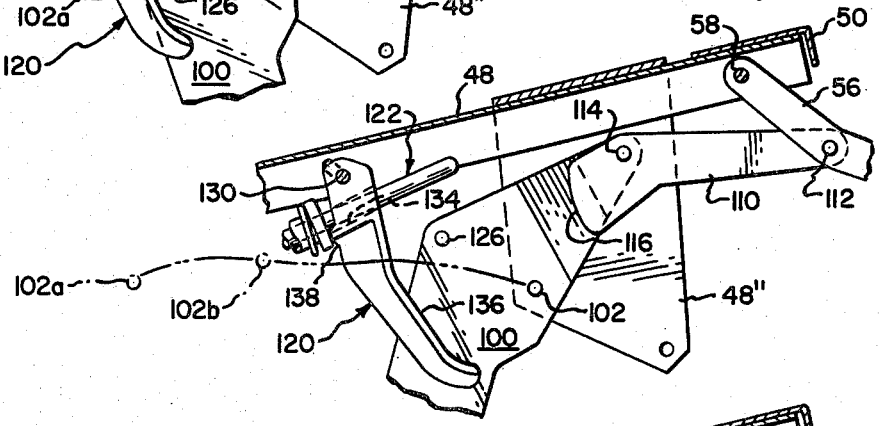
FIG. 7 is a sectional view similar to FIG. 5, but showing chair components in intermediate reclined position.

Friction device 120 is best known in FIGS. 5–8 being in the form of an elongated arm having its upper end mounted on seat portion 26 by means of a pivot pin 130 received within a slot opening 132 provided in seat side angle member 48, whereby to permit the friction device to undergo pivotal movements between its inoperative and operative positions shown for instance in FIGS. 5 and 7, respectively. The friction device is preferably formed of a rigid plastic material and characterized as having a through opening 134, a forwardly facing bearing or cam surface 136 and a rearwardly facing bearing surface 138. By reference to FIGS. 5 and 6, it will be understood that opening 134 is sized to freely slidably receive the front end of control rod 122 when disposed in essential axial alignment therewith, as an incident to placement of the friction device in its inoperative position. However, by reference to FIGS. 7 and 8, it will also be understood that the side walls of opening 134 are shaped and arranged to define friction surfaces adapted to be forced into surface-to-surface sliding engagement with the control rod upon pivotal movement of the friction device into its operative position.

Control rod 122 may be pivotally fixed to back rest mounting bracket 80 in any desired manner, but preferably the rear end of the rod is bent to define an integrally formed pivot pin extension **122*a*, which is received within and adapted to bear against the rear edge of an elongated slot opening 140 formed in the mounting bracket. Preferably, pin extension 122*a* would be adjustably positionally located in one of three positions spaced lengthwise of slot 140 by an adjustment mechanism generally designated as 142 for the purpose of selectively varying the torque characteristics of operating means 36 acting about the axis defined by upper rear pivot pins 82. The specific structure and mode of operation of adjustment mechanism 142** is the sole invention of Richard L. Watt, named herein.

Control rod 122 is best shown in FIGS. 2–4 and 8 as being fitted with a fixed stop or abutment 146 and as freely receiving a guide for spring device 124, which preferably is in the form of telescopically arranged front and rear tubular members **148*a* and 148*b* having enlarged end bearing portions 148*a'* and 148*b'*. As will be apparent, spring device 124 is disposed concentrically of members 148*a* and 148*b* with its opposite ends engaged with bearing portions 148*a'* and 148*b'* for biasing such bearing portions into engagement with bearing surface 138 of friction device 120 and rod stop 146**, respectively.

Operation of the chair assembly of the present invention will now be described with reference first being made to FIGS. 2 and 5, wherein components of chair frame 12 are shown in chair upright position. In chair upright position, foot rest portion 28 is disposed in its collapsed storage position, which is defined by engagement of link 56 with an L-shaped stop device 150 positionally located on mounting bracket 48'' by pivot pin 62. When link 56 is moved into engagement with stop device 150, control link 110 serves to prevent further counter-clockwise directed movements of front strut 100 about the axis of upper front pivot 102, as viewed in FIG. 2, and thus serves to establish the upright position of linkage 34 and seat portion 26. If desired, additional stop devices, not shown, may be provided to cooperate with stop device 150 for the purpose of defining the upright positions of these chair components.

Also in chair upright position back rest bracket 80 is maintained by the bias of spring device 124 in its upright position, which is defined by engagement of the back rest bracket with a suitable stop device 152 fixed to mounting flanges 48'. Further, in this position, control pin 126 carried by front strut 100 is disposed in engagement with a lower end portion of bearing surface 136 of friction device 120, whereby to retain the friction device in its inoperative position against the bias of spring device 124, and the front end of control rod 122 is disposed closely adjacent or in engagement with control link bearing surface 116.

The chair assembly of the present invention is stable in its upright position and absent purposeful occupant manipulation in the manner to be described, will not move into its intermediate reclined or TV position shown in FIG. 3. Stability is established by positioning upper rear pivot 82 over center or rearwardly of lower rear pivot pin 92, as best shown in FIG. 2; and by the positioning of upper front pivot 102 at a slightly lower elevation than adjacent intermediate positions it assumes during chair reclining movements to be described.

When an occupant wishes to move the chair assembly into its intermediate reclined or TV position illustrated in FIGS. 3 and 7, the occupant applies back pressure to back rest unit 20 in an amount sufficient to initiate rearwardly directed pivotal movements thereof relative to seat portion 26 about the axis defined by upper rear pivot pins 82 and against the bias established by spring device 124. Incident to such movement, control rod 122 is forced to move forwardly and thereby drive control link 110 towards an intermediate position thereof shown in FIG. 6, whereby to initiate reclining movements of seat portion 26 and extension of foot rest mounting linkage 30. During movement of control link 110 between its upright and intermediate positions, upper rear pivot pin 82 moves over center relative to lower rear pivot pin 92 and upper front pivot 102 pin is caused to move forwardly and upwardly along a path of travel shown in broken line in FIG. 6, wherein the numeral 102*a* is employed to designate the upright position of the upper front pivot pin. Upon positioning of upper front pivot pin 102 in the intermediate position along its path of travel shown in full in FIG. 6, the linkage of the present invention is such as to permit the seat and foot rest portion to coast or be propelled by the weight of the chair occupant into their reclined and extended supporting positions shown in FIGS. 3 and 7. The path of travel of upper front pivot pin 102 between its upright and reclined positions is shown in broken line in FIG. 7, wherein the above described upright and intermediate positions of the upper front pivot pin are designated by numerals 102*a* and 102*b*, respectively.

The intermediate reclined or TV position of the chair assembly is preferably defined by engagement of rear strut 90 with base portion side channel 40 in the manner shown in FIG. 3.

By again referring to FIGS. 5 and 6, it will be understood that during movement of control link 110 and upper front pivot pin 102 into their above described intermediate positions, clockwise directed pivotal movements of front strut 100 cause control pin 126 to slide or roll upwardly along bearing surface 136 of friction device 120, while maintaining the friction device in its inoperative position against the bias of spring device 124. At a point essentially coincident with placement of upper front pivot pin 102 in its intermediate position shown in FIG. 6, control pin 126 rides off of bearing surface 136, thereby permitting spring device 124 to pivot friction device 120 into its operative position, wherein the friction surfaces bounding opening 138 are biased into frictional surface engagement with control rod 122 and serve to establish a snubbing or frictional breaking force opposing continued forward movement of the control rod. By this arrangement, continued pivotal movement of back rest unit 20 is normally arrested until after the chair assembly is disposed in its intermediate reclined position shown in FIGS. 3 and 7, and the chair occupant intentionally applies additional pressure to the back rest unit in an amount sufficient to overcome both the bias of spring device 124 and the frictional braking force established by friction device 120. Depending on the stature and weight of the chair occupant, the amount of pressure exerted by simply leaning or resting the back of the occupant on back rest unit 20, while the chair is in its intermediate reclined position, will normally be such as will permit spring device 124 to maintain the back rest unit in its full upright position.

In the present construction, only a relatively slight pivotal movement of the back rest unit 20 relative to seat portion 26 on the order of about five degrees is required to move the chair components from their upright position shown in FIG. 5 into their intermediate position shown in FIG. 6.

The chair assembly is relatively stable in its intermediate reclined position. However, as previously noted, the chair occupant may intentionally apply pressure to back rest unit 20 in an amount sufficient to pivot same against the bias of spring device 124 and the frictional braking effect established by friction device 120, through successive occupant selected, partial back rest reclined positions, such as that shown for instance in FIG. 4, into its fully reclined position, not shown. The fully reclined position of the chair assembly may be suitably defined, such as by engagement of mounting brackets 80 and 80 with inturned stop flanges 48*a'* formed as part of mounting flanges 48' and 48'. It will be understood that the torque characteristics of operating means 36 are designed or may be adjusted to permit the back rest unit to be stable and remain in each of its positions against the driving torque imparted to the back rest unit by the weight of an occupant when simply leaning or resting his back thereon. An occupant may, however, progressively move the back rest unit rearwardly from any given one of its partial reclined positions into the next such position and eventually into its fully reclined position by purposely applying pressure or force to the back rest unit in addtion to the effective component of his weight acting thereon.

Figure 8:
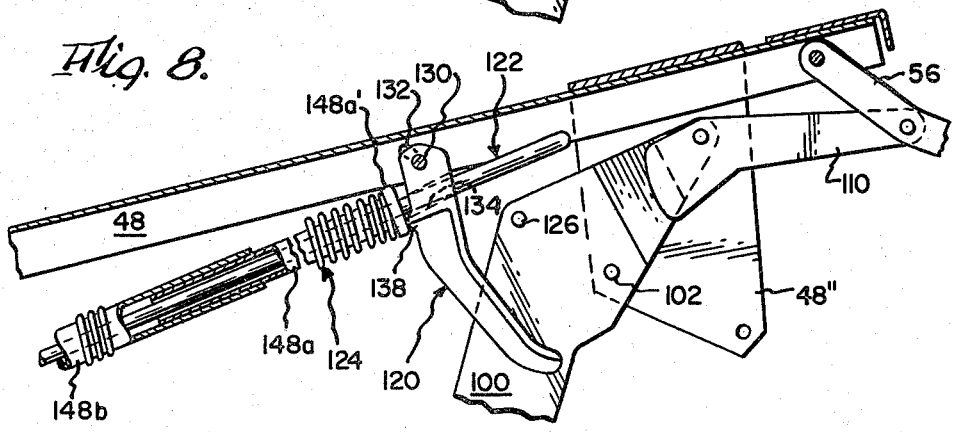
FIG. 8 is a sectional view similar to FIG. 5, but showing chair components in the partial back rest reclined position of the chair illustrated in FIG. 4.

By reference to FIG. 8, it will be noted that when the back rest unit is in one of its partially reclined or fully reclined positions, the forward end of control rod 122 is positioned such that its side surface would be engaged and the control rod bent by control link 110 in the event that the foot rest portion 28 would be accidentally forced to return to its storage position, such as by a child jumping onto the legs of the chair occupant. Damage to the control rod is prevented by the provision of slot opening 132, which permits upward movement of pivot pin 130 and thus the control rod against the return bias of spring device 124.

When it is desired to return the back rest unit to its upright position, the occupant would simply lean forward in the chair sufficiently to allow the spring device to return the back rest unit; the frictional braking force established by the friction device opposing the bias of the spring device in order to retard the force/speed at which the back rest unit is returned to upright position.

When it is desired to return the chair assembly to its upright position from its intermediate reclined or TV position, it is necessary for the occupant to intentionally apply leg pressure to foot rest unit 18 in an amount sufficient to cause upper front pivot pin 102 to be moved upwardly for return along its path of travel depicted in FIG. 7. It will be understood that, after the upper front pivot pin has been moved into a given intermediate position arranged along its return path of travel, the design of the present linkage is such as to permit the pivot pin to coast for return to its upright position designated as 102*a* in FIG. 7. As a result of frictional effects present in the chair assembly, the given intermediate position of the upper front pivot pin at which coasting commences, during return movement, will likely occur at some intermediate position other than that designated as 102*b* and probably at a position disposed relatively adjacent position 102*a*. The slight "valley" forming the mid-portion of the generally horizontally disposed path of travel of the upper front pivot pin depicted in FIG. 7 assists in slowing down the rate of movement of the chair assembly between upright and TV positions.

The utilization of compound linkage 104 to support front strut 100 in a manner permitting upper front pivot pin 102 to travel along the generally horizontally disposed path of travel depicted in FIG. 7, which terminates in stable upright and TV positions possesses advantage over the arcuate path of travel characteristic of prior chair assemblies of the type disclosed for instance by U.S. Pat. No. 3,743,349. Specifically, the present linkage serves to minimize the feeling of high speed movements and resultant abrupt stopping conditions incident to placement of the chair assembly in its upright and/or TV positions, without necessitating the introduction into the linkage of above normal motion retarding frictional forces, which would otherwise tend to increase the degree of effort required by an occupant to operate the chair. Otherwise stated, the present linkage requires relatively less effort to operate and permits the chair assembly to coast over a substantially greater portion of its movements without producing occupant jarring end conditions. Moreover, the present construction provides an occupant with a greater degree of comfort in operation, in that the occupant is subjected to a lesser degree of vertical movements incident to movement of the chair between its upright and reclined positions than that encountered in conventional chair assemblies of the type described.

While the present chair assembly has been described as having a unitized construction, wherein its base portion is supported directly on a floor surface, it will be apparent that the assembly may be modified to provide wholely independent right and left hand units in the manner disclosed for instance in U.S. Pat. No. 3,743,349, wherein the base portions of the units are fixed to opposite sides of a wooden or other suitable furniture structure and the seat portions of the units are fixed to opposite sides of a wooden or other suitable seat frame. Alternatively, the base portion of the present chair assembly may be modified, if desired, to permit mounting thereof on a conventional rocker assembly in a manner permitting the chair to undergo rocking movements while in its upright position.

Further, it is contemplated that a conventional hand operated crank arm may be employed to drive the control link for purposes of imparting reclinging movement to the seat portion, particularly in chair constructions of the type wherein the back rest unit is rigidly or nonmovably fixed to the seat portion.

We claim:

1. In a multiple position reclining chair assembly of the type including a base portion, a seat portion, a back rest portion carried by said seat portion, a foot rest portion, a foot rest mounting linkage for mounting said foot rest portion on said seat portion for movement relative thereto between a collapsed storage position and an extended supporting position, linkage means operably interconnecting said base portion and said seat portion and said foot rest mounting linkage for moving said seat portion from an upright position forwardly relative to said base portion to a reclined position while as an incident thereto actuating said mounting linkage to move said foot rest portion from said collapsed storage position to said extended supporting position, and operating means for actuating said linkage means, the improvement comprising in combination:

said linkage means includes front and rear linkage means for mounting front and rear portions of said seat portion for movement relative to said base portion, said rear linkage means including a rear strut and upper and lower rear pivot means for pivotally connecting upper and lower ends of said rear strut to said seat portion and said base, respectively, wherein said upper rear pivot means moves between upright and reclined positions thereof along an arcuate path of travel incident to movement of said seat portion between said upright and reclined positions, said reclined position of said upper rear pivot means being disposed forwardly and downwardly relative to said upright position thereof, said front linkage means including a front strut, upper front pivot means for pivotally connecting an upper portion of said front strut to said seat portion and a compound linkage means carried by said base portion and coupled to a lower portion of said front strut for supporting said front strut in a manner causing said upper front pivot means to move between upright and reclined positions thereof along a forwardly directed and generally horizontally disposed path of travel incident to movement of said seat portion between said upright and reclined positions, a control link pivotally connected adjacent its opposite ends to said foot rest mounting linkage and said front strut, and said control link is operably associated with said operating means and movable thereby to extend said foot rest portion towards said supporting position and move said seat portion towards said reclined position thereof.

2. A chair assembly according to claim 1, wherein said upper front pivot means, when in said upright and reclined positions thereof being disposed vertically below intermediate positions assumed thereby along the last said path of travel intermediate its said upright and reclined positions.

3. A chair assembly according to claim 2, wherein said back rest is mounted on said seat portion for rearwardly directed pivotal movements relative thereto between upright and reclined positions, said operating means is coupled to said back rest and responsive to movement thereof from its upright position to effect movement of said control link for extending said foot rest and moving said seat portion towards said reclined position thereof.

4. A chair assembly according to claim 3, wherein said operating means includes a friction device tending to oppose movement of said back rest from its upright position towards its reclined position and said linkage means additionally includes means for rendering said friction device inoperative during movement of said upper front pivot means between said upright position thereof and one of said intermediate positions at which the weight of a chair occupant supported by said seat portion becomes effective to propel said seat portion towards said reclined position thereof.

5. A chair assembly according to claim 3, wherein said operating means includes a friction device formed with friction surface means and mounted on said seat portion for movement between operative and inoperative positions, a control rod having a rear end mounted on said back rest and a front end slidably supported by said friction device, spring means tending to oppose pivotal movement of said back rest towards its reclined position and to bias said friction device from said inoperative position into said operative position thereof, wherein said friction surface means is removed from and disposed in operative frictional surface engagement with said control rod, respectively, and means carried by said front strut and arranged to engage with said friction device to maintain same in said inoperative position against the bias of said spring means during movement of said upper front pivot means between said upright position thereof and one of said intermediate positions at which the weight of a chair occupant supported by said seat portion tends to propel said seat portion towards said reclined position thereof, said front end of said control rod being arranged to removably engage with said control link to effect movement thereof as aforesaid by an amount at least sufficient to effect movement of said upper front pivot means from said upright position thereof into said one of said intermediate positions.

6. A chair assembly according to claim 1, wherein said back rest is mounted on said seat portion for pivotal movement relatively thereto about an axis defined by said rear strut upper pivot means between upright and reclined positions, said operating means has rear and front ends, said rear end is pivotally fixed to said back rest and said front end is disposed to removably engage with said control link incident to pivotal movement of said back rest from its upright position to initiate movement of said control link.

7. A chair assembly according to claim 2, wherein said base portion includes an upstanding front mounting flange and said compound linkage means includes front and rear hanger links having upper ends thereof pivotally fixed to said front mounting flange and lower ends thereof pivotally fixed to said lower portion of said front strut.

8. In a multiple position reclining chair assembly of the type including a base portion, a seat portion, a back rest portion carried by said seat portion for rearwardly directed reclining movement relative thereto, a foot rest portion, a foot rest mounting linkage for mounting said foot rest portion on said seat portion for movement relative thereto between a collapsed storage position and an extended supporting position, linkage means operably interconnecting said base portion and said seat portion and said foot rest mounting linkage for moving said seat portion from an upright position forwardly relative to said base portion to a reclined position while as an incident thereto actuating said mounting linkage to move said foot rest portion to said extended supporting position, and operating means for actuating said linkage means, the improvement comprising in combination:

said linkage means includes rear and front linkage means for mounting rear and front portions of said seat portion for forwardly and downwardly directed and forwardly and upwardly directed movements, respectively, relative to said base portion incident to movement of said seat portion between said upright and reclined positions, said front linkage means including a front strut having upper and lower ends movably coupled to said seat portion and said base portion, respectively, and a control link pivotally connected adjacent its opposite ends to said foot rest mounting linkage and said front strut for coupling same for conjunctive movements between their upright and storage positions and their reclined and extended positions, respectively, said linkage means being characterized as permitting coasting movement of said seat and foot rest portions into their reclined and supporting positions upon a given displacement of said control link from the position it occupies when said seat portion is in its upright position; and said operating means is coupled to said back rest portion and responsive to movement thereof from its upright position to effect said given displacement of said control link, characterized in that said control link is operably disconnected from said operating means during said coasting movement.

9. In a multiple position reclining chair assembly of the type including a base portion, a seat portion, a back rest portion carried by said seat portion for rearwardly directed reclining movement relative thereto, a foot rest portion, a foot rest mounting linkage for mounting said foot rest portion on said seat portion for movement relative thereto between a collapsed storage position and an extended supporting position, linkage means operably interconnecting said base portion and said seat portion and said foot rest mounting linkage for moving said seat portion from an upright position forwardly relative to said portion to a reclined position while as an incident thereto actuating said mounting linkage to move said foot rest portion to said extended supporting position, and operating means for actuating said linkage means, the improvement comprising in combination:

said linkage means includes rear and front linkage means for mounting rear and front portions of said seat portion for forwardly and downwardly directed and forwardly and upwardly direction movements, respectively, relative to said base portion incident to movement of said seat portion between said upright and reclined positions, said front linkage means including a front strut having upper and lower ends movably coupled to said seat portion and said base portion, respectively, and a control link pivotally connected adjacent its opposite ends to said foot rest mounting linkage and said front strut for coupling same for conjunctive movements between their upright and storage positions and their reclined and extended positions, respectively, said linkage means being characterized as permitting coasting movement of said seat and foot rest portions into their reclined and supporting positions upon a given displacement of said control link from the position it occupies when said seat portion is in its upright position; and said operating means includes a friction device formed with friction surface means and mounted on said seat portion for movement between operative and inoperative positions, a control rod having a rear end pivotally fixed to said back rest portion and a front end slidably supported by said friction device, spring means tending to oppose pivotal movement of said back rest towards its reclined position and to bias said friction device from said operative position into said operative position thereof, wherein said friction surface means is removed from and disposed in operative frictional surface engagement with said control rod, respectively, and means carried by said front strut and arranged to engage with said friction device to maintain same in said inoperative position against the bias of said spring means during said given displacement of said control link, and said front end of said control rod is arranged to removably engage with said control link to effect said given displacement thereof.

* * * * *

UNITED STATES PATENT AND TRADEMARK OFFICE

CERTIFICATE OF CORRECTION

PATENT NO. : 4,307,912

DATED : December 29, 1981

INVENTOR(S) : Richard L. Watt and Warren A. Waxham

It is certified that error appears in the above-identified patent and that said Letters Patent are hereby corrected as shown below:

Col. 4, Line 1 - "based" should be --- base ---.

Col. 7, Line 39 - "Pivot 102 pin" should be --- pivot pin 102 ---.

Col. 8, Line 52 - "addtion" should be --- addition ---.

Col. 13, Line 13 - The first occurrence of "operative" should be --- inoperative ---.

Signed and Sealed this

*Eleventh* Day of *May 1982*

[SEAL]

*Attest:*

GERALD J. MOSSINGHOFF

*Attesting Officer*

*Commissioner of Patents and Trademarks*